United States Patent [19]

Yamamoto

[11] Patent Number: 4,663,572

[45] Date of Patent: May 5, 1987

[54] PROCESS FOR SUPPRESSING ELECTRON BEAM DRIFT PHENOMENON IN A CATHODE RAY TUBE

[75] Inventor: Sumio Yamamoto, Nagaokakyo, Japan

[73] Assignee: Mitsubishi Denki Kabushiki Kaisha, Tokyo, Japan

[21] Appl. No.: 543,621

[22] Filed: Oct. 20, 1983

[30] Foreign Application Priority Data

Feb. 3, 1983 [JP] Japan ..... 58-17135

[51] Int. Cl.[4] ..... H01J 29/52; H01J 29/74

[52] U.S. Cl. ..... 315/383; 315/370; 313/437

[58] Field of Search ..... 315/383, 380, 381, 368, 315/8; 358/218, 219; 313/450, 437, 412, 432, 479, 477 HC; 445/5

[56] References Cited

U.S. PATENT DOCUMENTS

| | | | |
|---|---|---|---|
| 3,886,401 | 5/1975 | Berg | 315/8 |
| 3,955,116 | 5/1976 | van den Berg | 315/383 |
| 3,970,895 | 7/1976 | Willis | 315/383 |
| 3,980,925 | 9/1976 | Awata et al. | 315/380 |
| 4,091,311 | 5/1978 | Mendelsohn et al. | 315/382 |

*Primary Examiner*—Theodore M. Blum
*Assistant Examiner*—Gregory C. Issing
*Attorney, Agent, or Firm*—Lowe Price LeBlanc Becker & Shur

[57] ABSTRACT

By application of a predetermined period of relatively higher magnitude of electron beam emission from the cathode of the electron gun to the anode maintained at high voltage the potential gradient on the inside of the neck portion of a cathode ray tube is stabilized and the phenomenon of electron beam drift is thus suppressed effectively.

24 Claims, 4 Drawing Figures

PROCESS FOR SUPPRESSING ELECTRON BEAM DRIFT PHENOMENON IN A CATHODE RAY TUBE

BACKGROUND OF THE INVENTION

1. Field of the Invention

The present invention relates to a cathode ray tube, and relates more particularly to a process for suppressing phenomenon of electron beam drift in a cathode ray tube.

2. Description of the Prior Art

FIG. 1 is a schematic sectional view of a conventional cathode ray tube. In a neck portion 1*a* of an envelope 1 of the cathode ray tube, an electron gun device 2 including three electron guns 2R, 2G, and 2B is provided. A fluorescent screen 3 is provided on the inside of the front portion opposite to the neck portion 1*a* of the cathode ray tube, and a shadow mask 4 is provided on the inner side thereof.

Three electron beams emitted from the electron gun device 2 are focused by a deflecting coil (not shown) to converge into a point on the fluorescent screen 3 through the shadow mask 4. To assure that the electron beams are thus converged into a point, the electron guns of the electron gun device 2 are tilted slightly while a four-pole magnet ring 5 is rotatably provided around the neck portion 1*a* for making adjustment, a so-called static convergence adjustment.

FIG. 2 is an enlarged sectional view of the electron gun device 2 shown in FIG. 1 including cathodes 21R, 21G, and 21B, a control electrode 22, an accelerating electrode 23, a focusing electrode 24, and an anode 25. The anode 25 is held at the same potential as the shadow mask 4 and the fluorescent screen 3. The neck portion 1*a* is made of insulating glass.

At the time of normal operation of the electron gun device 2, the anode 25 is applied with a high voltage of 20 KV with the cathodes 21R, 21G and 21B being applied with zero voltage. Ideally, it is preferred that the insulating inner wall of the neck portion 1*a* is brought to a state in accordance with such potential gradient as stated above so that the electron beam is influenced by stable electrostatic force from the neck portion 1*a*.

However, at the time of manufacture of the cathode ray tube, a different voltage from that at the normal operation is sometimes applied to the cathode for the purpose of activation process of the cathode, for example, which causes the potential gradient on the neck portion 1*a* to gradually vary with time until a stable potential gradient is established therein by virtue of gradual penetration of the anode voltage into the neck portion 1*a* in the subsequent continued normal operation. Accordingly, electrostatic force from the neck portion 1*a* which is exerted on the electron beam gradually varies, thereby causing gradual variation in the trajectory of the electron beam. Thus a gradual displacement of the electron beam spot on the fluorescent screen 3 with time, a so-called drift phenomenon, occurs.

The drift amount of the electron beam on the fluorescent screen is about 0.1 to 0.3 mm after 10 to 20 minutes of normal operation. Therefore, it has hitherto been possible to make the drift amount so small as to cause no hindrance in practical use of the cathode ray tube by means of the raster aging for 10 to 20 minutes or by the convergence adjustment with the four-pole magnet at the time of adjustments after manufacture of the cathode ray tube. Recently, however, as external diameter of the neck glass has become smaller, from 36 or 29 mm to 22.5 mm, the stabilizing time for the electron beam drift has become longer.

FIG. 3 shows graphs plotting the electron beam drift amounts measured for 22.5 mm cathode ray tubes. In FIG. 3, a dotted line graph A relates to a conventional cathode ray tube, and solid line graphs B and C relate to cathode ray tubes treated with the process in accordance with the present invention. In FIG. 3, the ordinate represents static convergence drift (in mm) and the abscissa represents the normal operating time (in hours). As apparent from the dotted line A in FIG. 3, the drift amount becomes 1.5 to 2 mm after 1.5 to 2 hours of normal operation and thereafter it is stable. Thus, the cathode ray tubes with smaller neck diameter have been found to have the disadvantage of long stabilizing time.

SUMMARY OF THE INVENTION

The present invention is directed to a process for suppressing electron beam drift phenomenon in a cathode ray tube having a plurality of electron guns within a neck portion theref, each electron gun including an anode. The drift phenomenon results from gradual variation of electrostatic force from the neck portion which is exerted on an electron beam. The process in accordance with the present invention comprises the steps of applying relatively higher voltage to the anode and exposing the electron gun to relatively higher magnitude of electron beam emission for a predetermined period so that the above described drift phenomenon is suppressed effectively.

Therefore, a principal object of the present invention is to provide a process for suppressing electron beam drift phenomenon in a cathode ray tube having a neck protion of small diameter for shortening a stabilizing time for the drift.

This object and other objects, features, aspects and advantages of the present invention will becomes more apparent from the following detail description of the present invention when taken in conjunction with the accompanying drawings.

DESCRIPTION OF THE PREFERRED EMBODIMENTS

Figure 1:
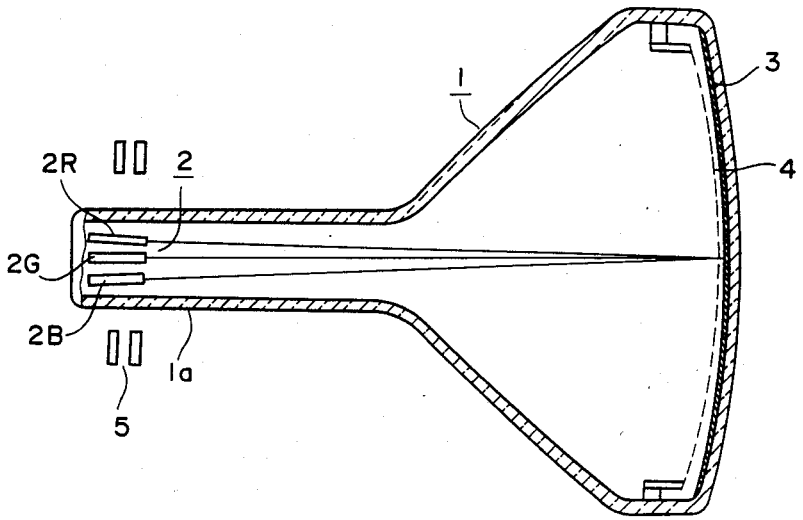
FIG. 1 is a schematic sectional view of a conventional cathode ray tube to which the process in accordance with the present invention is applicable.

A preferred embodiment of a process for suppressing electron beam drift phenomenon in accordance with the present invention will be described in the following with reference to FIG. 2. After an activation process for cathodes 21R, 21G, and 21B, a so-called maximum emission process is practiced in the inventive process for at least 5 seconds, in which a control electrode 22 is maintained at the same potential as the cathodes 21R, 21G, and 21B, an accelerating electrode 23 is set at 300 to 400 V, a focusing electrode 24 is set at 4 to 5 kV, and an anode 25 is set at 20 to 25 kV. In normal operation of a cathode ray tube, the control electrode is set at −100 V to −150 V so that the magnitude of the emitted electron beam is controlled. In the present preferred embodiment, the maximum emission process is applied for at least 5 seconds maintaining the control electrode 22 at the same potential as the cathodes 21R, 21G, and 21B to increase the electron beam emission, prior to the normal operation wherein the control electrode 22 is set at a negative voltage to control the electron beam emission from the cathodes 21R, 21G, and 21B. Since, in the maximum emission process, about 3 mA of current flows from the cathodes 21R, 21G, and 21B, the high potential on the anode 25 is induced on the neck portion 1*a* in a short time through the current (so-called shower effect). By virtue of the shower effect, the potential gradient on the neck portion 1*a* reaches a stable state in a short time.

Figure 3:
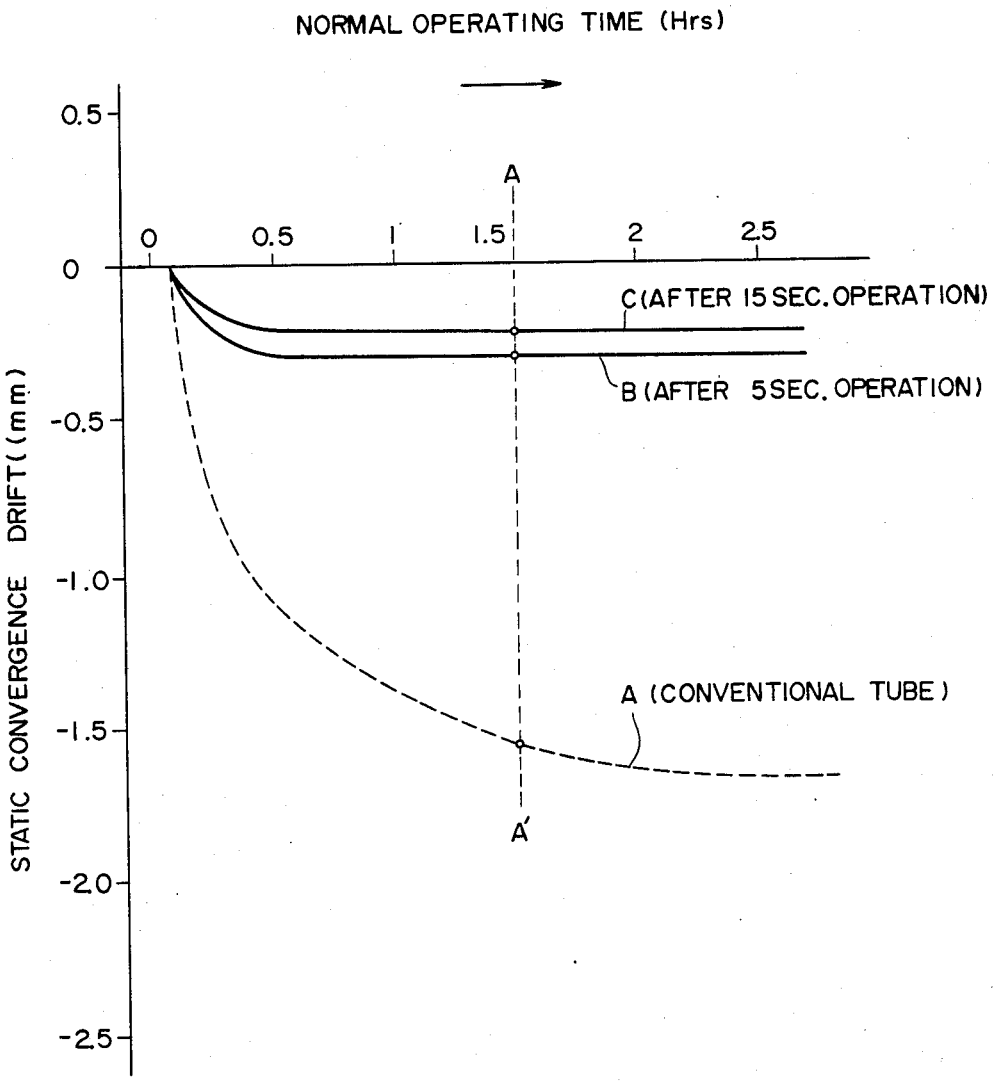
FIG. 3 is a graph showing relationship between static convergence drift and normal cathode ray tube operation time.

The solid lines B and C in FIG. 3 show effects brought by application of the maximum emission process. The solid lines B and C represent the relationship between the static convergence drift amount and the normal operation time after the maximum emission processes for 5 seconds and for 15 seconds, respectively. As is apparent from the comparison of these curves with the curve A, the electron beam drift can be decreased greatly and the stable state of the drift can be reached in an extremely short time by the application of the maximum emission process in accordance with the present invention.

Figure 4:
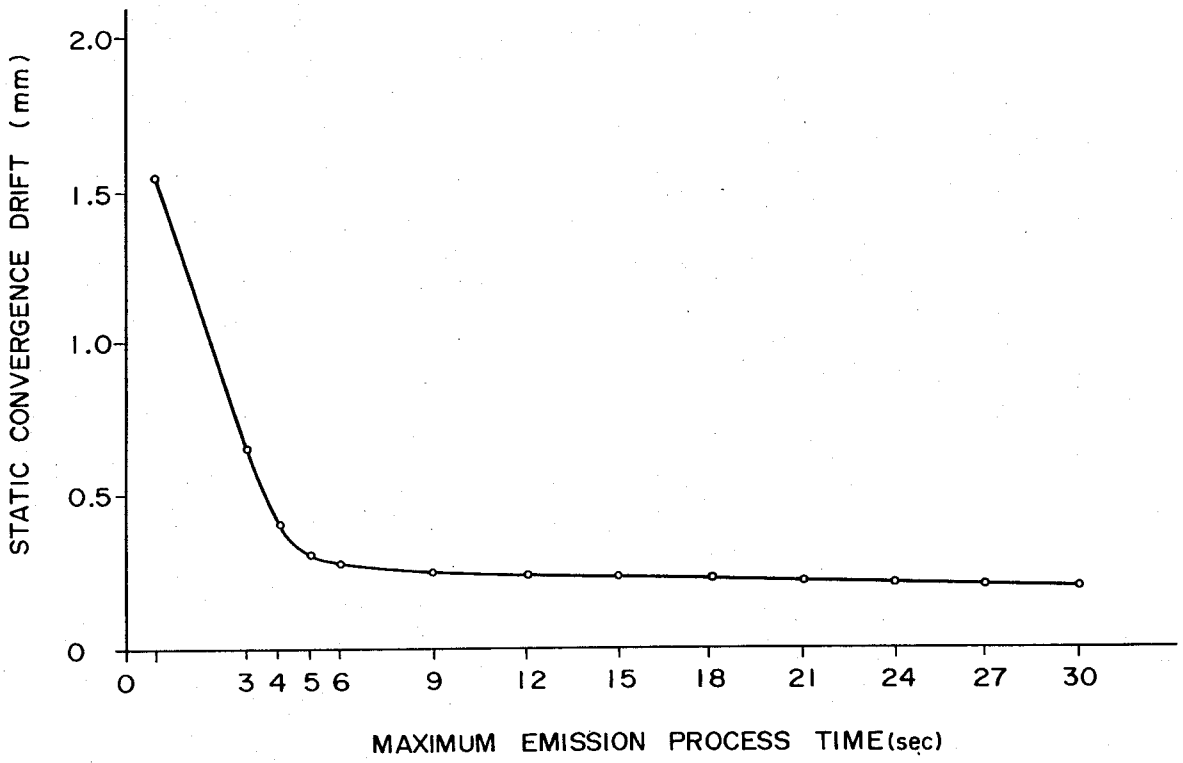
FIG. 4 is a graph showing relationship between electron beam drift after 1.5 hours of normal operation and maximum emission process time.

FIG. 4 shows the electron beam drift (in mm) after 1.5 hours of normal operation as a function of the maximum emission process time (in seconds). As is clear from the experimental results in FIG. 4, the maximum emission process is required to be applied for at least 5 seconds. In the conventional manufacturing process, a maximum emission has been applied. However, it has been practiced for testing the emission amount and therefore the emission time has only been 1 to 2 seconds.

Consequently, as easily understood from FIG. 4, improvement in the amount of drift is not provided in the prior art because the maximum emission is terminated before the potential gradient on the neck portion becomes uniform. Thus, the conventional maximum emission process practiced for the purpose of examining the emission amount has not been useful for suppression of the drift phenomenon caused by nonuniformity of the potential gradient on the neck portion of the cathode ray tube. As previously described, in the prior art the conventional cathode ray tube is subjected to the above emission process for only 1 to 2 seconds and the drift phenomenon therein is not improved.

Figure 2:
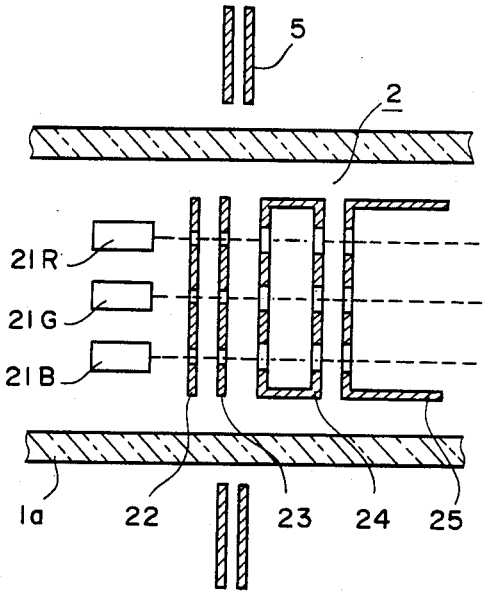
FIG. 2 is an enlarged view of an electron gun device 2 shown in FIG. 1 to which the process in accordance with the present invention is applicable.

In the case of the electron gun of in-line type as shown in FIG. 2, the maximum emission process may be applied only to the cathodes 21R and 21B on both sides, closer to the neck portion 1*a*. The middle cathode 21G does not necessarily need the process since the electrostatic force from the neck portion 1*a* acts thereon symmetrically from both sides.

In the above described preferred embodiment, the process was practiced with the maximum emission amount, but a lower emission amount being closer thereto may be employed to produce the same effect as in the above described embodiment by slightly increasing the processing time.

Furthermore, the emission process may be applied to each cathode one by one or to all the cathodes at a time.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A process for suppressing an electron beam drift phenomenon in a cathode ray tube having a plurality of electron guns within a neck portion thereof, each electron gun including an anode portion, wherein said drift phenomenon results from gradual variation of electrostatic force from the neck portion which is exerted on an electron beam, comprising the steps of:

applying to said anode portion a voltage equal to or greater than applied during normal operation; and causing said electron gun to generate for a predetermined time period a beam emission having a magnitude greater than beam emission magnitudes for normal operation so that said drift phenomenon is effectively suppressed.

2. A process in accordance with claim 1, wherein said magnitude of greater electron beam emission substantially corresponds to maximum electron beam emission of said electron gun.

3. A process in accordance with claim 2, wherein said predetermined time period is at least 5 seconds.

4. A process in accordance with claim 3, wherein said relatively higher voltage is equal to or higher than the voltage applied to said anode portion at the time of normal operation of said cathode ray tube.

5. A process in accordance with claim 4, wherein each of said electron guns further includes a cathode and a control electrode portion and comprising the step of maintaining said control electrode portion at the same potential as said cathode.

6. A process in accordance with claim 5, wherein said variation of electrostatic force results from an activation process of said cathodes of said electron guns.

7. A process in accordance with claim 6, wherein said neck portion is relatively small in diameter.

8. A process in accordance with claim 1 wherein said cathode ray tube includes a control electrode portion and comprising the further step of applying to said control electrode portion a relatively higher voltage than applied during normal operation.

9. A process in accordance with claim 1 wherein each of said electron guns includes a cathode, and comprising the further step of applying to at least one of said cathodes a relatively higher voltage than applied during normal operation.

10. A process in accordance with claim 9 wherein said cathode ray tube includes a control electrode portion and comprising the further step of applying to said control electrode portion a relatively higher voltage than applied during normal operation.

11. A process in accordance with claim 10 comprising the further step of maintaning said control electrode portion at the same potential as said at least one of said cathodes.

12. A process for suppressing an electron beam drift phenomenon in a cathode ray tube having a plurality of electron guns within a neck portion thereof, each electron gun including a cathode, wherein said drift phenomenon results from gradual variation of electrostatic force from the neck portion which is exerted of an electron beam, comprising the steps of:

applying to at least one of said cathodes a relatively higher voltage than applied during normal operation; and causing said electron gun to generate for a predetermined time period a beam emission having a magnitude greater than beam emission magnitudes for normal operation so that said drift phenomenon is effectively suppressed.

13. A process for suppressing electron beam drift phenomena resulting form variation of electrostatic force exerted from a small-diameter neck portion of a cathode ray tube on an electron beam emitted by a plurality of electron guns within the neck portion comprising the steps of:

after manufacture and initial activation processes of a cathode, stabilizing electron beam drift by causing the electron gun to generate an electron beam emission having a magnitude greater than an electron beam emission magnitude obtained during normal operation of the cathode ray tube, and selecting a predetermined time period sufficient for the greater electron beam emission magnitude to reduce the amount of drift and to reduce time necessary for stabilizing the drift of the electron beam.

14. The process recited in claim 13 wherein said stabilizing step includes the step of causing the electron gun to generate a maximum electron beam emission for the predetermined period.

15. The process recited in claim 14 wherein said selecting step comprises the step of selecting said predetermined time period to be at least five seconds.

16. The process recited in claim 14 wherein said stabilizing step comprises the step of applying to an anode of said cathode ray tube a voltage at least equal to or greater than a normal operating voltage for said anode.

17. The process recited in claim 16 wherein said applying step comprises the step of applying to the anode a voltage in the range of 20,000 to 25,000 volts.

18. The process recited in claim 17 wherein said applying step further comprises the step of applying a voltage in the range of 300 to 400 volts to an accelerating electrode and of maintaining the cathode at a common potential with a control electrode of said cathode ray tube.

19. The process recited in claim 13 wherein said manufacture of said cathode ray tube includes the step of forming said neck portion to a diameter less than 29 mm.

20. A process for suppressing electron beam drift phenomena in a cathode ray tube having a neck portion of an outer diameter less than 29 mm and a plurality of electron guns within the neck portion, each electron gun having a cathode, a control electrode and an anode, comprising the steps of:

after an activation process for the cathodes in the electron guns, applying to the anodes a voltage greater than that applied in normal operation and causing the cathodes and the control electrodes to be at the same potential, and causing said electron guns to generate for at least 5 seconds a beam emission having a magnitude greater than beam emission magnitudes for normal operation so that said drift phenomena are effectively suppressed.

21. A method for suppressing electron beam drift phenomena in a cathode ray tube having a neck portion of an outer diameter less than 29 mm and a plurality of electron guns within the neck portion, each of said electron guns having a cathode, comprising the steps of:

activating the cathodes of said electron guns in said cathode ray tube and, thereafter, causing said electron guns to operate for a predetermined time period at a beam emission magnitude greater than beam emission magnitudes for normal operation thereof.

22. A method as recited in claim 21 wherein said causing step comprises the step of applying to electrodes of said electron guns voltage levels selected for causing said electron guns to generate a maximum beam emission magnitude for said cathode ray tube for said predetermined time period.

23. A method as recited in claim 2 wherein said applying step comprises the step of maintaining a control electrode at a common potential with the cathodes of said electron guns.

24. A method as recited in claim 23 wherein said maintaining step comprises the step of maintaining the control electrode at said common potential with the cathodes of said electron guns for at least five seconds.

* * * * *